US008419315B2

(12) United States Patent
Grimont

(10) Patent No.: US 8,419,315 B2
(45) Date of Patent: Apr. 16, 2013

(54) HARBOR STRUCTURE AND A METHOD OF BUILDING SUCH A STRUCTURE

(75) Inventor: Damien Grimont, Arradon (FR)

(73) Assignee: Compagnie du Sol, Nanterre (FR)

( * ) Notice: Subject to any disclaimer, the term of this patent is extended or adjusted under 35 U.S.C. 154(b) by 363 days.

(21) Appl. No.: 12/084,631

(22) PCT Filed: Nov. 7, 2006

(86) PCT No.: PCT/FR2006/051146

§ 371 (c)(1),
(2), (4) Date: Jul. 22, 2008

(87) PCT Pub. No.: WO2007/054654

PCT Pub. Date: May 18, 2007

(65) Prior Publication Data

US 2009/0142139 A1 Jun. 4, 2009

(30) Foreign Application Priority Data

Nov. 9, 2005 (FR) ..... 05 11382

(51) Int. Cl.
*E02D 3/00* (2006.01)
*E02D 23/00* (2006.01)

(52) U.S. Cl.
USPC ..... 405/195.1; 114/258

(58) Field of Classification Search ..... 405/195.1, 405/107, 108, 114, 116, 118, 11, 14; 210/170.01, 210/170.09, 170.1, 170.11; 114/258; 4/489
See application file for complete search history.

(56) References Cited

U.S. PATENT DOCUMENTS

| | | | | | |
|---|---|---|---|---|---|
| 1,750,224 | A | * | 3/1930 | King | 114/258 |
| 2,044,795 | A | * | 6/1936 | Knight | 405/203 |
| 2,705,403 | A | * | 4/1955 | Ebert | 405/13 |
| 3,124,935 | A | | 3/1964 | Foster | |
| 3,287,921 | A | * | 11/1966 | Wilson et al. | 405/3 |
| 3,509,727 | A | | 5/1970 | Zorab et al. | |
| 4,386,872 | A | * | 6/1983 | Smith | 405/13 |
| 4,480,945 | A | * | 11/1984 | Schnabel, Jr. | 405/262 |
| 4,648,752 | A | * | 3/1987 | Guy et al. | 405/217 |
| 4,701,075 | A | * | 10/1987 | Martyshenko et al. | 405/217 |
| 4,799,828 | A | * | 1/1989 | Georgii | 405/195.1 |
| 4,963,058 | A | * | 10/1990 | Broughton et al. | 405/207 |
| 4,993,347 | A | * | 2/1991 | Filho | 405/218 |

(Continued)

FOREIGN PATENT DOCUMENTS

FR 2 866 359 A 8/2005

OTHER PUBLICATIONS

Australian Patent Office, Examiner's Report in related Australian patent application No. 2006313645, dated Feb. 18, 2011.

(Continued)

*Primary Examiner* — Tara M. Pinnock
(74) *Attorney, Agent, or Firm* — Kenyon & Kenyon LLP

(57) ABSTRACT

The invention relates to a method of building a harbor structure suitable for communicating with a stretch of water. The invention is characterized in that the method consists in making, in a piece of ground, at least one curved continuous wall having a closed outline, in digging out the volume defined by the continuous wall, and in providing at least one opening in the continuous wall, said opening making it possible to cause said volume to communicate with the stretch of water.

23 Claims, 7 Drawing Sheets

U.S. PATENT DOCUMENTS

| | | | | |
|---|---|---|---|---|
| 5,292,207 | A * | 3/1994 | Scott | 405/207 |
| 5,720,056 | A * | 2/1998 | Aymes | 4/488 |
| 5,938,374 | A * | 8/1999 | Nakase et al. | 405/205 |
| 5,993,111 | A * | 11/1999 | Holloway, Jr. | 405/39 |
| 6,052,963 | A * | 4/2000 | Lefort et al. | 52/741.13 |
| 6,234,714 | B1 * | 5/2001 | Chattey | 405/8 |
| 7,297,258 | B2 * | 11/2007 | Gomes De Oliveira | 210/221.2 |
| 7,497,945 | B2 * | 3/2009 | Solomon et al. | 210/154 |
| 2007/0274785 | A1 * | 11/2007 | Fonfrede et al. | 405/107 |

OTHER PUBLICATIONS

European Patent Office, International Search Report in International Application No. PCT/FR2006/051146, dated Mar. 30, 2007.

French Patent Office, Preliminary Search Report in related French patent application No. 0511382, dated Jul. 26, 2006.

* cited by examiner

HARBOR STRUCTURE AND A METHOD OF BUILDING SUCH A STRUCTURE

This is a 371 national phase application of PCT/FR2006/051146 filed 7 Nov. 2006, claiming priority to French Patent Application No. FR 0511382 filed 9 Nov. 2005, the contents of which are incorporated herein by reference.

FIELD OF THE INVENTION

The present invention relates to the field of coastal engineering, and more precisely to the field of harbor engineering.

The present invention relates more particularly to a method of building a harbor structure that is suitable for communicating with a stretch of water.

The stretch of water can be an ocean, a sea, a lake, a dock, a harbor, or any other sort of stretch of water.

BACKGROUND OF THE INVENTION

A method of building a harbor on a coast or shore is already known. However, the choice of location for a new harbor is generally limited by topographical and environmental constraints.

The feasibility of building a harbor is usually dependent on the existence of a suitable natural geographical configuration.

For example, it is necessary for the land to form a roadstead, a fjord, or a natural breakwater, in order to serve as a basis on which to build the harbor.

In addition, some kinds of terrain prevent harbors from being built. In particular loamy-sand and silty terrains prevent quays from being built under economically acceptable conditions.

It can thus be understood that locations lending themselves to harbor building are in limited supply.

Document U.S. Pat. No. 3,124,935 is also known and that document describes a harbor structure having a continuous wall of sheet piling, which wall is made up of a plurality of arches whose concave sides face outwards from the harbor structure, the ends of the arches being connected to cylindrical cells.

SUMMARY OF THE INVENTION

A first object of the present invention is to provide a harbor structure that is not dependent on coastline topography or on the kind of terrain.

A second object of the invention is to provide a harbor structure that is obtained by implementing the method.

The invention achieves its objects by the fact that the method consists in making, in a piece of ground, at least one curved continuous wall having a closed outline and comprising at least one arcuate wall segment whose concave side faces towards the inside of the structure so as to present an arch effect relative to the outside of the structure, in digging out at least a fraction of the volume defined by the continuous wall, and in providing at least one opening in the continuous wall, said opening making it possible to cause said volume to communicate with the stretch of water.

The term "piece of ground" is used herein to mean any surface in which it is possible to make a wall, i.e., for example, a piece of land, a layer of fill, a foreshore, a seabed, or any other type of surface.

A wall that is said herein to be "curved" is a wall having an outline that is essentially made up of curved lines.

That is to say, in accordance with the invention, the total length of said curved lines represents more than 50% of the total length of the outline of the wall and, preferably, the total length of said curved lines represents more than 75% of the total length of the outline of the wall, in order to improve the self-stability of the continuous wall.

In other words, the continuous wall of the invention can have rectilinear segments, but the total length of such rectilinear segments must not exceed 50% (preferably 25%) of the total length of the outline of the continuous wall.

In the meaning of the invention, when the harbor structure comprises a single arcuate wall segment, the harbor structure is in the shape of a cylinder provided with an opening.

Preferably, the continuous wall is made while also providing the opening in said continuous wall, and then all or a fraction of the volume defined by the continuous wall is dug out. However, it is also possible to provide the opening after the volume defined by the continuous wall has been dug out.

In the meaning of the invention, the term "continuous wall" is use to include both a wall that can be made in one piece, and also a continuous wall made in pieces, i.e. made by juxtaposing continuous wall segments.

In addition, the continuous wall preferably extends into the ground in a substantially vertical direction.

As a result, in accordance with the invention, the harbor structure can be built equally well on land and in a stretch of water.

Thus, the continuous wall can be surrounded entirely or partially with soil (or with some similar material) or with water, so that the continuous wall forms an interface between water and land, or indeed between two volumes of water.

It can be understood that the continuous wall forms retaining means making it possible to retain the outside environment disposed on the outside periphery of the continuous wall, which outside periphery is preferably constituted by the convex side of the continuous wall.

In an implementation of the invention, the ground in which the wall is made is the bottom of a stretch of water, so that the wall is suitable for being partially or entirely immersed in the stretch of water.

In a preferred implementation of the invention, the volume defined by the continuous wall is dug out over a fraction of the height of the wall.

Since not all of the volume defined by the inside of the wall is dug out, it can be understood that the lower portion of the wall is surrounded by ground so that the wall is anchored in the ground, the anchoring depth thus corresponding to the fraction of the height of the wall that is not cleared by digging out.

The minimum anchoring depth is a function both of the type of the terrain and also of the dimensions of the continuous wall.

In a preferred implementation of the invention, the continuous wall is a diaphragm wall.

The technique of making diaphragm walls is already known and consists essentially in digging a trench segment, generally using a "Hydrofraise" hydraulic trencher cutter or any other ground trench excavation equipment, while filling the trench with slurry in order to support its sides, and then in casting concrete in said trench segment in order to make a wall element or panel.

Then, another trench is dug adjacent to the previously-formed trench segment so as to make another segment of the continuous wall.

That process is repeated until the continuous wall of the desired shape is obtained.

By means of the technique of making diaphragm walls, it is easy to make continuous walls in pieces of any shape and outline, and in particular of curved outline.

In another implementation, the continuous wall is made up of a plurality of cast piles.

The technique of making cast piles is already known and consists in drilling a well in the ground, e.g. by means of an auger, and in filling the well with concrete.

It is also possible to use an auger equipped with a tube making it possible to inject concrete regularly into the well while the auger is being withdrawn.

In order to make a wall that is continuous, it is possible, for example, to make two non-intersecting primary cast piles and then, after the concrete has set, to drill a well that is secondary to the two primary piles, and to fill it with concrete.

It is also possible to make non-intersecting piles that are connected together by a suitable waterproofing covering.

That process is repeated until the continuous wall of the desired shape is obtained.

In another implementation, the continuous wall is made of reinforced concrete.

That technique is already known and it consists essentially in forming shuttering that is provided with reinforcement before concrete is cast into it.

It can be understood that, in the above-indicated diaphragm-wall and cast-pile techniques, the continuous wall having a curved outline is made up of a plurality of individual segments of short length, two adjacent individual segments being slightly inclined relative to each other.

In the meaning of the invention, the individual segments of a curved wall do not constitute rectilinear segments and are not taken into consideration when calculating the total length of rectilinear segments of the continuous wall.

In particular, when the curved continuous wall is a diaphragm wall, it can be understood that a curved segment is made up of juxtaposed rectilinear panels that are inclined relative to one another, each of the panels presenting a length that is short compared with the total length of the continuous wall, so that the curved segment corresponds to the envelope of the juxtaposed rectilinear panels.

Without going beyond the ambit of the present invention, it is possible to make provision for the continuous wall to be made by combining the four above-described techniques.

An advantage of the above-described techniques is that it is easy to make continuous walls in wide variety of kinds of terrain, ranging from rocky to muddy or sandy.

It can thus be understood that an advantage of the method of the invention is that it is easy to make a harbor structure on ground that does not lend itself to conventional harbor building, or at least that would make conventional harbor building very costly.

The opening provided in the diaphragm wall can extend over all or a fraction of the height of the wall. Preferably, the opening has a height less than the height of the wall as measured from the bottom of the harbor structure.

In addition, in accordance with the invention, any opening width can be imagined, even though an opening width that is small compared with the perimeter of the wall is preferred.

Preferably, the opening is in the shape of a notch formed in an upper portion of the continuous wall.

Said notch has side edges that can be vertical or inclined so that the notch is V-shaped, or indeed trapezoid-shaped, the small base of the trapezoid being situated below the large base, or else it can be stair-shaped.

Once the harbor structure has been built, its inside volume is filled with water, e.g. by using pumps and/or via the opening that communicates with the stretch of water.

Once the harbor structure is full, it can be understood that the opening forms an access enabling boats to go between the stretch of water and the inside of the harbor structure.

Naturally, the depth of the opening is dimensioned as a function of the draughts of the boats that the harbor structure is designed to receive.

On reading the above, it can be understood that the harbor structure of the invention can be built on land.

In accordance with the invention, it is also possible to build the harbor structure in a stretch of water or, at least, partly in a stretch of water and partly on a coast.

For this purpose, an additional step is performed that consists advantageously in putting down fill extending from the coast towards the stretch of water, and in making said continuous wall at least in part in the fill.

Preferably, the fill advantageously constitutes a sort of mold for making the continuous wall.

In a preferred embodiment of the invention, the continuous wall is made of a diaphragm wall or is made of a plurality of cast piles.

In order to make a continuous wall that is disposed partly on the coast and partly in the stretch of water, it can be understood that a fraction of the wall is made in the coast while the other fraction is made in the fill.

In a preferred implementation of the invention, the continuous wall extends to a depth greater than the depth of the seabed so that the harbor structure is anchored in the ground.

In addition, in the invention, it is possible for the volume defined by the continuous wall to be dug out to a depth greater than the depth of the seabed vertically in register with the continuous wall.

Preferably, the opening is provided in the fraction of continuous wall made in the fill, and the fill is dug out, at least in register with the opening, in a manner such that the volume communicates with the stretch of water.

It can thus be understood that the fill that is dug out is the fill that is situated on the outside periphery of the continuous wall in addition to the fill situated inside the volume defined by the continuous wall.

Since the fill has been put down in the stretch of water, it can be understood that, when the fill is dug out, that fraction of the continuous wall that was made in that fill becomes surrounded by water. In some circumstances, it can be advantageous to leave at least a fraction of the fill in place as protection for the structure, and as means for improving the self-stability of the wall.

Since the thrust exerted by the water on the outside periphery of that fraction of the wall is less than the thrust that would be exerted by the soil, it can be understood that digging out the fill advantageously makes it possible to reduce the forces to which the continuous wall is subjected.

The present invention also provides a harbor structure that comprises at least one curved continuous wall having a closed outline and suitable for making a dock, said wall being provided with at least one opening communicating with the stretch of water to enable a boat to pass through, the harbor structure being characterized in that the continuous wall comprises at least one arcuate wall segment whose concave side faces towards the inside of the structure so as to present an arch effect relative to the outside of the structure.

Preferably, the continuous wall is made as a diaphragm wall, but it could also be made of cast piles or of reinforced concrete.

In a preferred embodiment, the continuous wall is anchored in the ground so that the depth of the dock is less than the total height of the wall.

In addition, a wall that is said to be "continuous" also includes a wall that is piece-wise continuous.

Advantageously, the continuous wall is cylindrical in shape.

In accordance with the invention, the terms "cylindrical" or "cylinder" are to be understood in their broadest sense, namely as designating a set of parallel straight lines defining a "directrix" curve that, in this example, is closed.

The directrix forms a closed curve that can be a deformed ellipse, an oval, or any other closed curve.

In a preferred embodiment, the continuous wall is in the shape of a cylinder having an elliptical or a circular base.

In other words, the directrix is, in this example, an ellipse or a circle, so that the dock is circular or elliptical.

An advantage of a dock having a circular outline lies in the fact that it makes it possible to take up diametrically opposite forces pressing on the continuous wall.

As a result, this particular shape advantageously makes it possible to omit additional means for supporting the cylindrical, elliptical, or circular continuous wall.

In other words, such a continuous wall is self-stable in that it is not necessary to add support means to it in order to secure stability for it.

Furthermore, it can be understood that such self-stability exists both when the continuous wall is disposed in land, and when it is disposed in a stretch of water.

Advantageously, the continuous wall comprises a plurality of arcuate wall segments connected together via their ends, said arcuate wall segments having their concave sides facing towards the inside of the structure so as to present arch effects relative to the outside of the structure.

It is also possible to build harbor structures that extend over large areas by juxtaposing arcuate walls.

Preferably, the harbor structure presents at least one plane of symmetry so that an arcuate wall is suitable for taking up the forces to which the arcuate wall that is symmetrical to it is subjected.

For this purpose, the ends of two symmetrical arcuate walls are advantageously interconnected via force take-up elements such as, for example, beams.

In a particularly advantageous embodiment of the invention, the dock-forming continuous wall is provided with closure means suitable for closing the wall in watertight manner relative to the stretch of water.

Preferably, said closure means comprise a gate suitable for closing off said opening.

Even more preferably, said gate comprises a panel suitable for moving vertically so as to close the opening.

Advantageously, the harbor structure further comprises pump means designed to empty the dock of the water it is suitable for containing.

Naturally, the pump means are designed to be activated once the opening is closed off.

Preferably, the continuous wall is in the shape of a cylinder having a circular directrix so that the structure can withstand the pressure exerted by the soil flanking the convex side of the diaphragm wall, which pressure is particularly high when the dock is empty.

Optionally, it is possible to make provision to make a floor forming a slab at the bottom of the dock, thereby making it possible to improve the support for the continuous wall.

Such a dock can advantageously serve as a basis for building a structure of the graving dock or dry dock type.

Advantageously, such a structure further comprises a ramp extending along the inside periphery of the dock from the upper portion thereof to the lower portion thereof.

In this example, provision is made for the width of the ramp to be large enough for a vehicle to be able to access the bottom of the dock when said dock is in the emptied state.

Advantageously, said structure further comprises at least one floating dock raft suitable for moving vertically as a function of the depth of water contained in the dock.

Preferably, the floating dock raft is guided as it moves by guide means co-operating with the continuous wall.

The floating dock raft is preferably provided with float means enabling it to be kept above the level of the water contained in the dock.

Preferably, the graving dock of the invention is provided with at least one cradle suitable for co-operating with a boat moored to the floating dock raft, and with means for positioning the cradle, so that as the dock is emptying, said means position the cradle under the boat in order to carry the boat once the dock is in the emptied state.

In an advantageous embodiment, the harbor structure of the invention comprises a plurality of continuous walls having closed outlines and suitable for forming docks, said continuous walls forming docks that communicate with one another via their openings.

It can be understood that, in this embodiment, the harbor structure is suitable for forming an access channel for boats.

In other words, the plurality of continuous walls form an access channel via which a boat can access the stretch of water by going successively through the openings provided in the respective continuous walls.

Since the continuous walls of the invention can be made in the stretch of water or in the ground, it can be understood that the present invention makes it easy to build a channel extending from a zone of the stretch of water that is remote from the coast to a zone that is situated inland.

Preferably, one of the continuous walls of the channel has a portion immersed in the stretch of water.

Preferably, this wall corresponds to the continuous wall situated at the same end of the channel as the stretch of water.

In this example, this end wall is provided with an opening formed in the portion that is immersed, which opening forms the main communicating passage between the stretch of water and the access channel.

Preferably, the channel presents a length sufficient to ensure that said portion is always immersed, in particular at low tide when the stretch of water is, for example, an ocean.

BRIEF DESCRIPTION OF THE DRAWINGS

The invention can be better understood and its advantages appear more clearly on reading the following detailed description of embodiments given by way of non-limiting example. The description refers to the drawings, in which.

DETAILED DESCRIPTION

In the following description of preferred embodiments of the invention, the continuous wall is a diaphragm wall. However, as indicated above, other building techniques can be imagined.

The harbor structure concept defined in the present invention can be implemented in a plurality of embodiments that can naturally be combined to form more complex harbor structure configurations.

The present invention makes it possible, particularly, but not exclusively, to build marinas, graving docks, and access channels.

In addition, the harbor structure of the invention offers the advantage of being modular.

The harbor structure of the invention can comprise one or more modules forming docks that are interconnected.

Figure 1A:
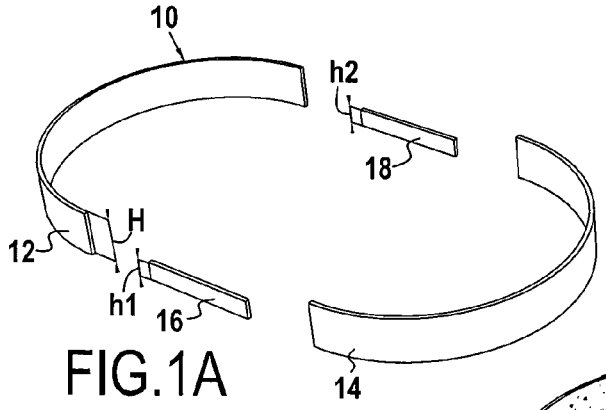
FIGS. 1A-1C are exploded perspective views of diaphragm walls of the invention.
Figure 1B:
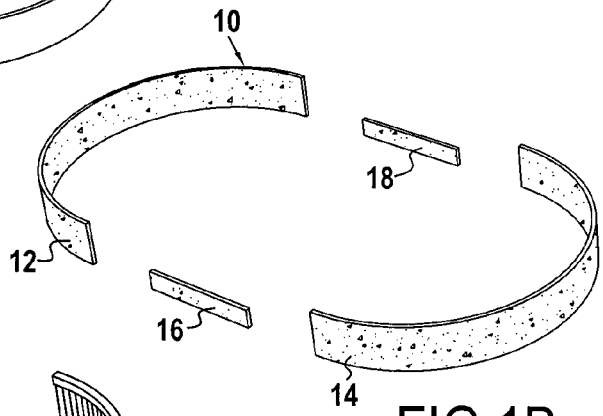
Figure 1C:
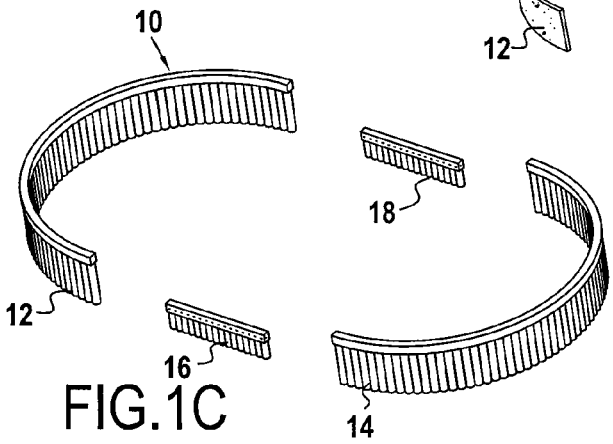

FIG. 1 is an exploded perspective view of an embodiment of an individual module 10 in the meaning of the invention, which module is made up of diaphragm walls comprising two arcuate diaphragm wall segments 12, 14 that are interconnected via two rectilinear diaphragm wall segments 16, 18. However, the rectilinear segments are merely optional. In any event, the total length of the rectilinear segments is less than 25% of the total length of the outline of the module 10.

The technique of building diaphragm walls is already known, and is not described in detail herein.

As explained below, this embodiment is in no way limiting on the present invention, it being possible for the module to have any other shape, particularly but not exclusively a cylindrical shape having a circular base (or a circular directrix).

A module can usually have a width (or a diameter) lying in the range 10 meters (m) to 100 m. In certain cases, its width or diameter can be considerably greater than 100 m.

Figure 2:
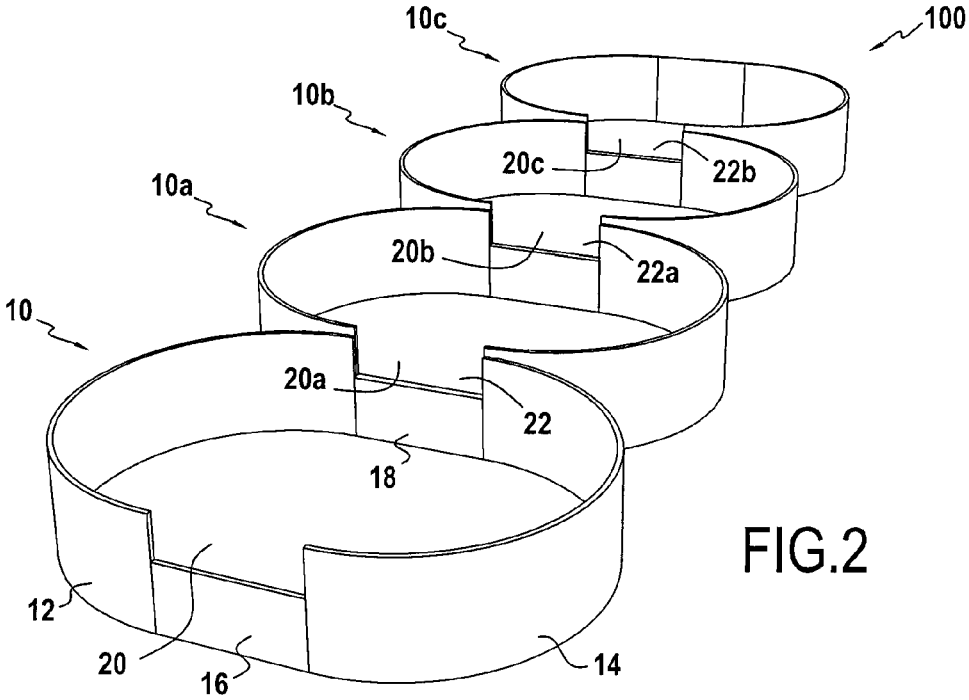
FIG. 2 is a perspective view showing, on its own, a harbor structure of the invention that is made up of a four diaphragm wall elements.

As can be seen in FIG. 2, the individual module forms a curved continuous wall having a closed outline that is substantially elliptical in shape.

In the example shown in FIG. 1, the height H of the arcuate walls 12, 14 is greater than the height h1, h2 of the rectilinear wall segments 16, 18, so that the module 10 has two openings 20, 22 provided in the upper portion of the dock-forming module 10.

The total height H of the arcuate wall segments preferably lies in the range 5 m to 40 m, while the usual thickness of the wall lies in the range 20 centimeters (cm) to 200 cm. It can however be greater than 200 cm.

It can be seen that each of the openings 20, 22 is notch-shaped.

A first embodiment of the harbor structure 100 of the invention that is made up of an assembly of four modules 10, 10*a*, 10*b*, and 10*c* of the invention is shown in FIG. 2.

It can be seen that the first, second, and third modules 10, 10*a*, and 10*b* are identical, and that each of them is provided with two openings, respectively referenced 20 & 22, 20*a* & 22*a*, and 20*b* & 22*b*, while the fourth module 10*c* is provided with a single opening 20*c* only.

As can be seen in FIG. 2, the modules are disposed side by side so that the rectilinear wall segments of two adjacent modules are in contact with each other.

It can thus be seen that the openings of two adjacent modules substantially coincide so as to form a passage between two adjacent modules.

Figure 3:
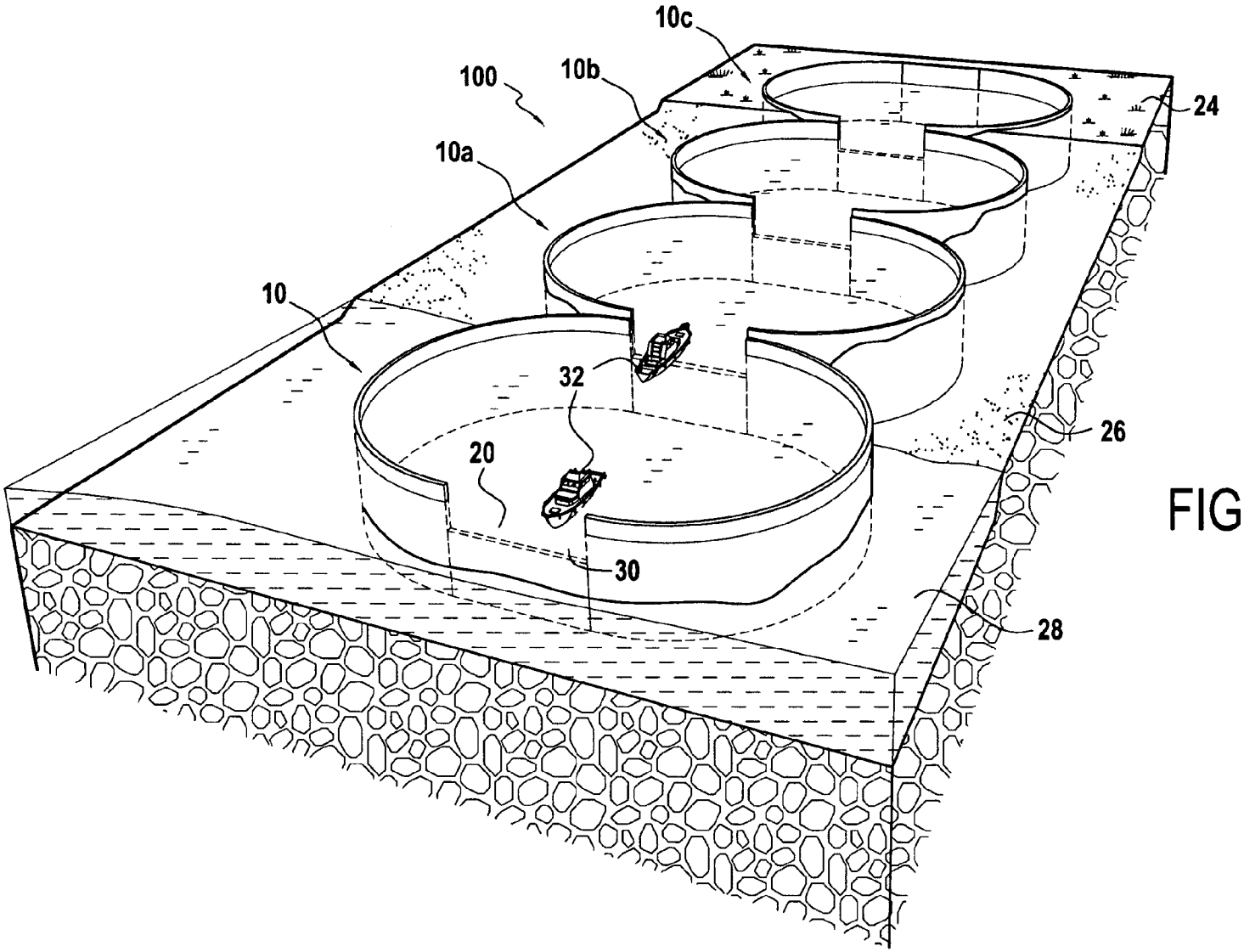
FIG. 3 is a perspective view of the harbor structure of FIG. 2, as integrated into a coastal environment.

FIG. 3 shows the first embodiment of a harbor structure 100 as integrated into the coastal environment in which it is built.

The method of building such a structure is described in detail below.

The coastal environment shown in FIG. 3 comprises a coast 24, a foreshore 26, and a stretch of water 28 which, in this example, is an ocean.

It can be seen that, in this first embodiment, the harbor structure extends between the stretch of water and the coast, and communicates with the stretch of water via the opening 20 in the first module.

As can be seen in FIG. 3, the second, third, and fourth modules 10*a*, 10*g*, 10*c* are sunk into the ground, whereas the first module 10 is sunk into the stretch of water 28.

Furthermore, the second and third modules 10*a*, 10*b* are built on the foreshore, while the fourth module is built on the coast which is never under water regardless of the tide.

It can be seen that the opening 20 in the first module makes it possible to cause the inside volume of the harbor structure 100 to communicate with the stretch of water, thereby in particular making it possible to fill the harbor structure 100 with water on putting the harbor structure in place.

In addition, and as can be seen in FIG. 3, said opening 20 has a bottom edge 30 immersed at a depth sufficient to enable boats 32 to enter or leave the structure of the invention. Fill can be used to protect and/or reinforce the self-stability of the structure.

In this embodiment, the fourth module forms a dock for docking boats, and can be equipped with floating dock rafts (not shown).

It can also be seen that, by means of the invention, boats 32 can reach the fourth module by passing through the first, second, and third modules which, in this example, form an access channel for accessing the fourth module 10*c*.

At low tide, as shown in FIG. 3, the structure of the invention still enables the boats to enter the access channel since the opening 20 in the first module is always under water, regardless of the tide.

Without going beyond the ambit of the invention, it is advantageously possible to connect two adjacent modules together via a lock, in particular if the terrain slopes steeply.

Figure 4:
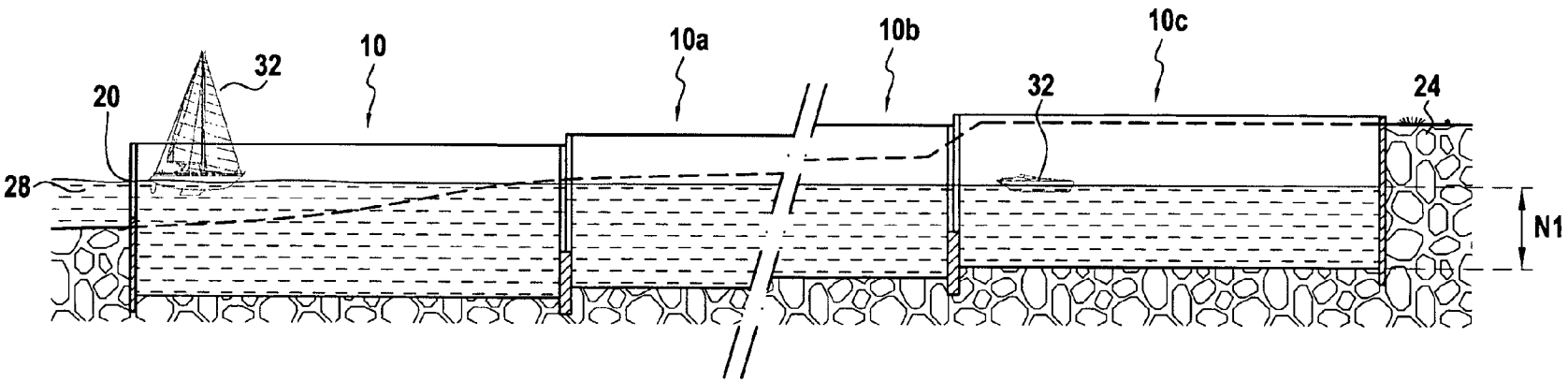
FIG. 4 is a side section view of a harbor structure of the invention that is made of four diaphragm wall elements, the structure being shown at low tide.
Figure 5:
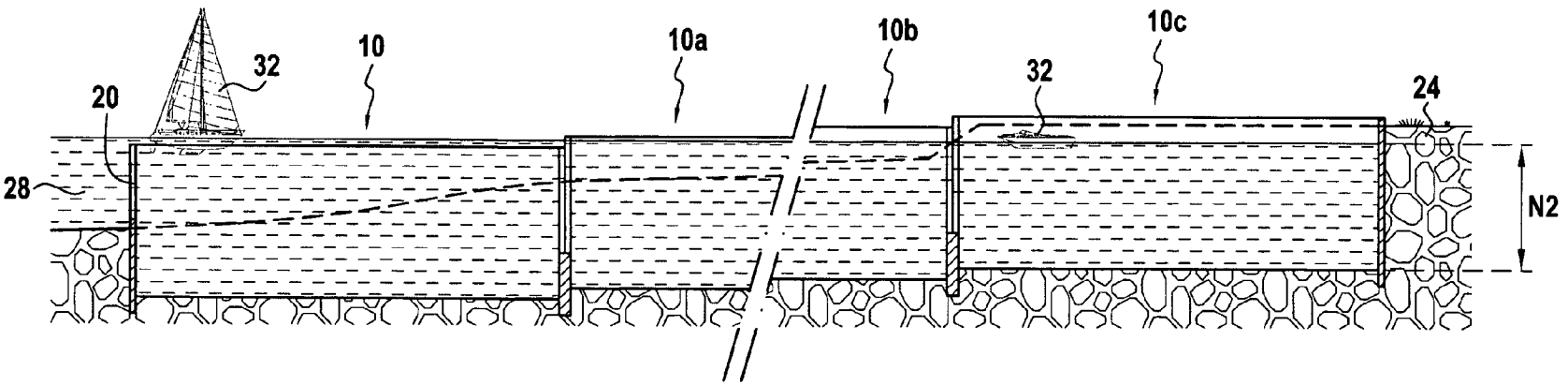
FIG. 5 is a side section view of a harbor structure of the invention that is made up of four diaphragm wall elements, the structure being shown at high tide.

FIG. 4 is a section view of the harbor structure 100 at low tide and on a vertical plane extending between the stretch of water 28 and the coast 24, while FIG. 5 shows the same view at high tide.

In both figures, the dashed lines represent the ground level on either side of the structure 100, while N1 and N2 represent the water level in the fourth module respectively at low tide and at high tide.

As can be seen in the two figures, the diaphragm walls of each of the modules 10, 10*a*, 10*b*, and 10*c* are advantageously anchored in the ground by the fact that the diaphragm wall segments 12, 14, 16, and 18 extend vertically to a depth greater than the depth of the bottom of the dock.

In addition, it can be understood that, in accordance with the invention, the number of modules provided is sufficient for the end module (the first module in this example) always to have its opening 20 sufficiently far under water for boats to be able to enter and to leave the channel regardless of the tide.

Furthermore, the passages constituted by juxtaposing the openings 22 & 20*a*, 22*a* & 20*b*, and 22*b* & 20*c* are dimensioned so as to present respective bottom edges that are always far enough under water for boats to pass through said passages at low tide.

As can be seen in FIG. 5, the first module 10 is under water at high tide. For safety reasons, it is possible to add beacons indicating the position of the opening 20.

It can thus be understood that juxtaposing the modules makes it possible advantageously to lead out to the natural deepwater zone.

In particular, assembling the modules together makes it possible to protect a deepwater channel from silting up (with silt not produced by sedimentation) since terrain having weak mechanical characteristics cannot penetrate into the modules because the openings are provided in the upper portions of the continuous walls.

It can also be understood that the length, the width, and the depth of the channel vary as a function of the slope of the foreshore, and can be adapted to match any configuration by providing the necessary number of modules to reach the desired natural depth zone.

Figure 7:
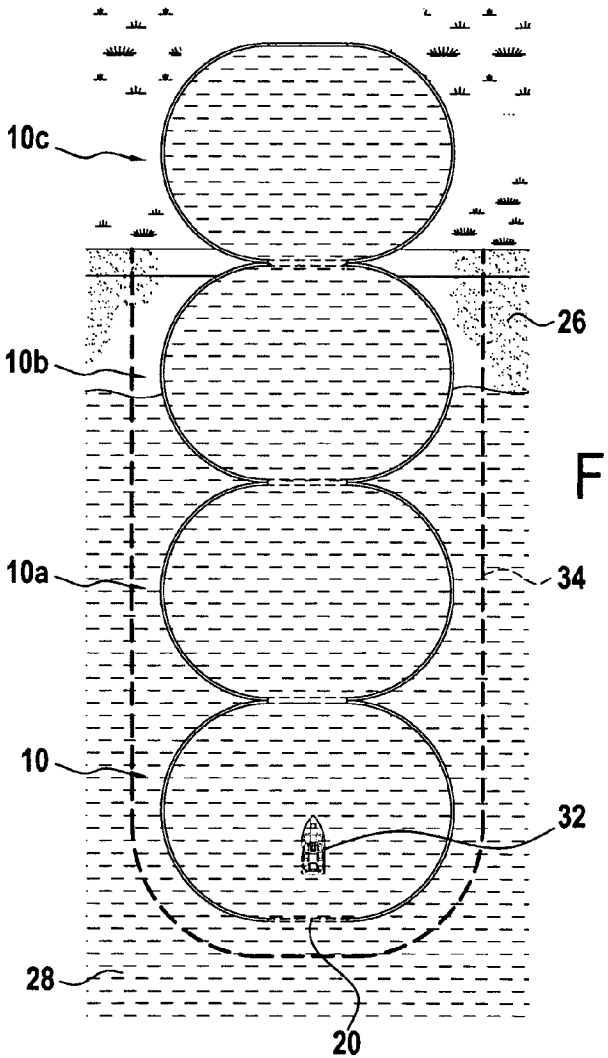
FIG. 7 is a plan view of the harbor structure of FIG. 4.
Figure 6:
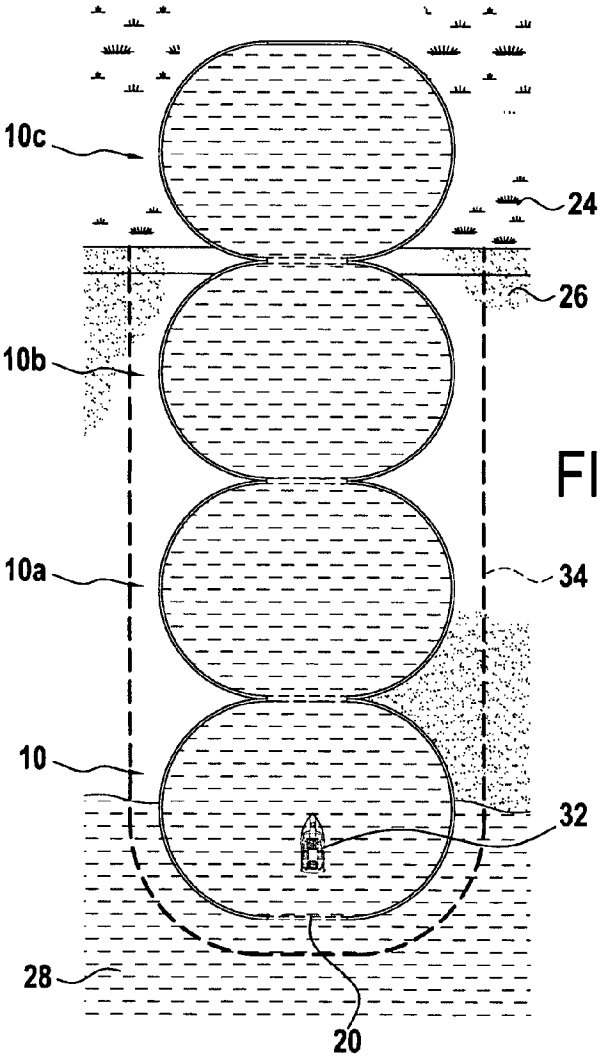
FIG. 6 is a plan view of the harbor structure of FIG. 3.

FIGS. 6 and 7 are plan views of the first embodiment of the invention, diagrammatically showing a boat 32 entering the channel respectively at low tide and at high tide.

In accordance with the invention, the channel is advantageously built in the following manner: a layer of fill 34 is put down from the coast 24 to a zone of the stretch of water 28 that is always under water regardless of the tide.

The layer of fill 34 (represented by dashed lines in FIGS. 6 and 7) is in the form of a spit of land rising to a height greater than the level of the stretch of water 28.

Then the fill is flattened over its entire length, so as to form a plateau extending the coast towards the stretch of water.

When the ground slopes steeply, it is also possible to form a plurality of plateaus having different heights, thereby forming terraces.

The wall could also be made from a barge.

The next step consists in making, both in the fill and in the ground of the coast 24, a plurality of diaphragm wall segments so as to form the four juxtaposed modules shown in FIG. 2.

It can thus be understood that the fill advantageously serves as a mold for making the diaphragm walls, in particular on the foreshore 26 and in the stretch of water 28.

Preferably, trench segments are dug to a depth greater than the height of the fill, i.e. the trench segment is also dug in the natural ground situated beneath the fill in order to anchor the diaphragm wall into the natural ground.

When the concrete of the diaphragm walls has set, the soil situated inside the volume defined by the continuous wall, i.e. inside the modules, is dug out, preferably over a fraction of the height of the wall so that the continuous wall is blocked between the soil remaining at the bottoms of the modules and the ground flanking the outsides of the modules.

Preferably, the fill that is situated around the outside peripheries of the modules built in the stretch of water is also dug out so that those modules are surrounded by water.

When designing the structure, it is also necessary to take account of the soil movements due to the tides (silting up, and washing out).

Figure 8:
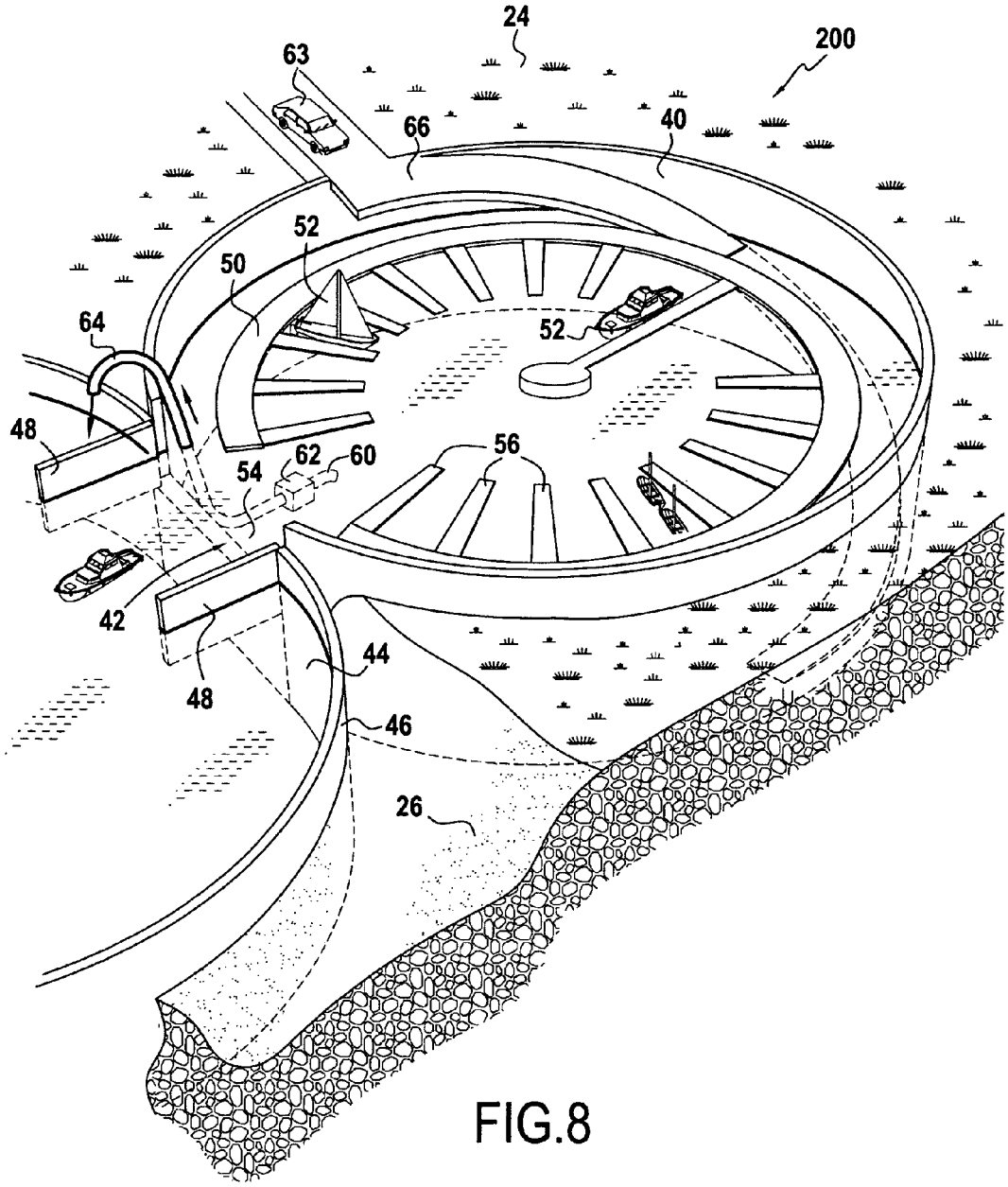
FIG. 8 is a perspective view of a wall element forming a graving dock of the invention.
Figure 9:
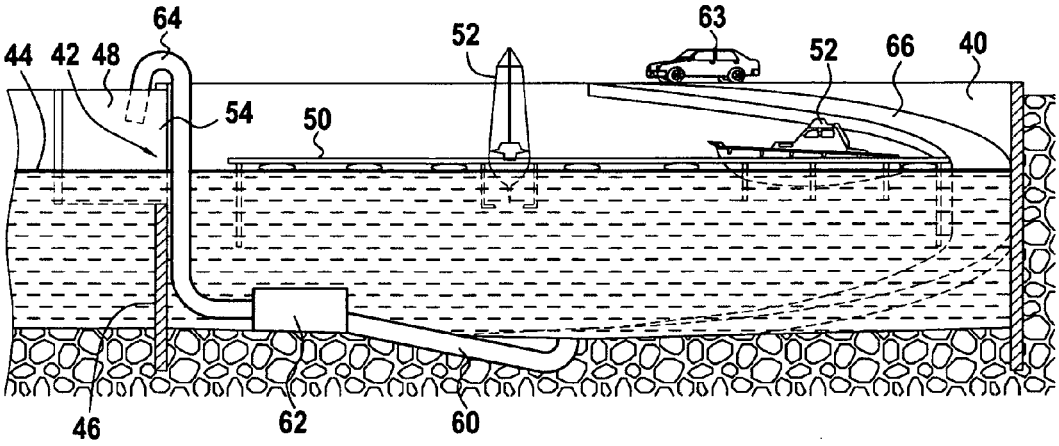
FIG. 9 is side section view of the graving dock of FIG. 8, showing the dock when full.
Figure 10:
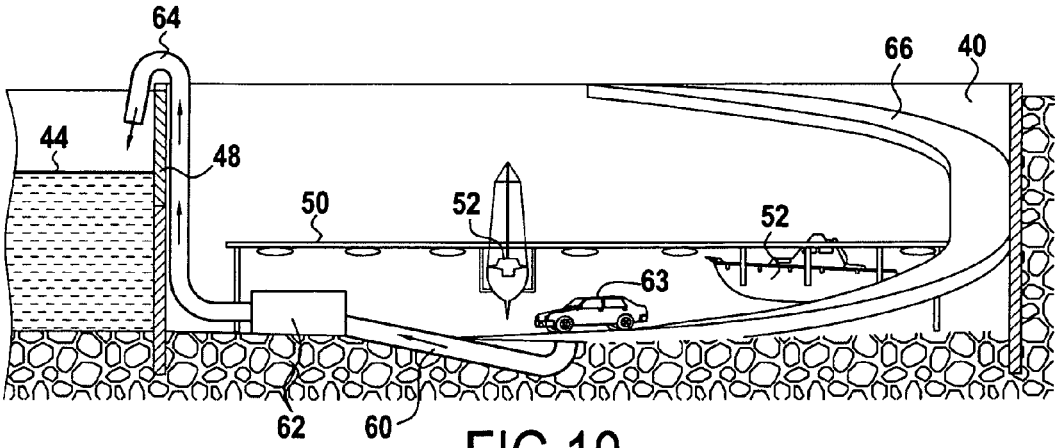
FIG. 10 is a side section view of the graving dock of FIG. 8, showing the dock when empty.

With reference to FIGS. 8 to 10, a description follows of a second embodiment of the harbor structure of the invention, relating to a graving dock or dry dock.

This harbor structure 200 includes a module 40 that is in the general shape of a circular-base cylinder that is sunk into the ground, which module is preferably made of diaphragm walls.

In a variant, it is also possible to imagine that the base can have an elliptical, oval, or substantially circular shape.

In other words, unlike the modules of the first embodiment, the module of the second embodiment is made up of a curved diaphragm wall only.

An advantage of this configuration is described in detail below.

Said module 40, which is suitable for forming a dock, is provided with an opening 42 formed in the upper portion of the diaphragm wall and enabling the module 40 to be caused to communicate with a stretch of water 44, which, in this example, is a dock 46.

However, the stretch of water can be another module of the invention, or a structure of the first embodiment of the invention, or any other sort of stretch of water.

The module 40 is further provided with closure means 48 shown in FIG. 8 designed to close the opening 42 in watertight manner.

The closure means 48 are in the form of a double hinged gate. It is also possible to provide a sliding gate having a vertical opening system, or with any other type of suitable watertight gate.

The graving dock 200 is also provided with a floating dock raft 50 to which boats 50 can moor.

As can be seen in FIG. 8, the floating dock raft 50 forms a circular arc following the inside periphery of the module 40, the floating dock raft being provided with an opening 54 for enabling the boats to enter and to leave the graving dock.

The floating dock raft 50 is further provided with a plurality of boat-mooring and landing piers 56 extending orthogonally towards the center of the dock, two successive piers co-operating to define a boat mooring.

The graving dock 200 is also provided with pump means 58 disposed at the bottom of the dock 200 and enabling said dock to be emptied while the opening 42 is closed off by the watertight closure means 48, as shown in FIG. 10.

The pump means 58 comprise a tube 60 opening out at the bottom of the dock, the tube 60 being connected to a pump 62 and to a discharge pipe 64 opening out in the neighboring stretch of water 44.

As can be seen in FIGS. 8 to 10, a ramp 66 extending between the upper portion of the module 40 and the bottom of the dock 200, while also extending along the inside periphery of the module 40, enables vehicles 63 to access the bottom of the dock 200.

When the graving dock 200 is in the emptied state, it can be understood that the pressure that is exerted on the diaphragm wall of the module 40 is greater than when the dock is full.

By means of the cylindrical shape of the diaphragm wall, the module 40, even when it is empty, is suitable for taking up the forces exerted by the ground. This effect is further accentuated if the continuous wall of said module 40 is given a substantially circular shape.

Optionally, the dock 200 of the invention can be provided with a floor forming a slab (not shown) making it possible to improve the supporting of the diaphragm wall of the module 40.

In addition, the floating dock raft 50 is suitable for moving vertically as a function of the depth of water contained in the graving dock 200.

For this purpose, it is possible, for example, to equip the floating dock raft 50 with floats that enable it to remain above the water level.

Guide means (not shown), e.g. runners mounted on the inside face of the diaphragm wall, make it possible to guide the floating dock raft as it moves vertically.

Furthermore, the floating dock raft 50 is preferably further provided with means for carrying the boats 52 moored to the floating dock raft 50 when the graving dock is in the emptied state.

Said means are in the form of cradles mounted under the piers 56 and are suitable for carrying the boats situated in the moorings.

Provision is made such that, when the graving dock 200 is empty, the floating dock raft 50 is held at a certain height above the bottom of the dock so that the hull of the boat 52 to be graved comes to be received in the corresponding cradle.

Naturally, said means for carrying the boats could be used in other types of graving docks that are not part of the present invention.

The structure described with reference to FIGS. 8 to 10 can also serve to protect boats against risks related to cyclones or tropical storms. For that purpose, it suffices to empty the water out of the dock or to lower the level of water therein significantly.

Figure 11:
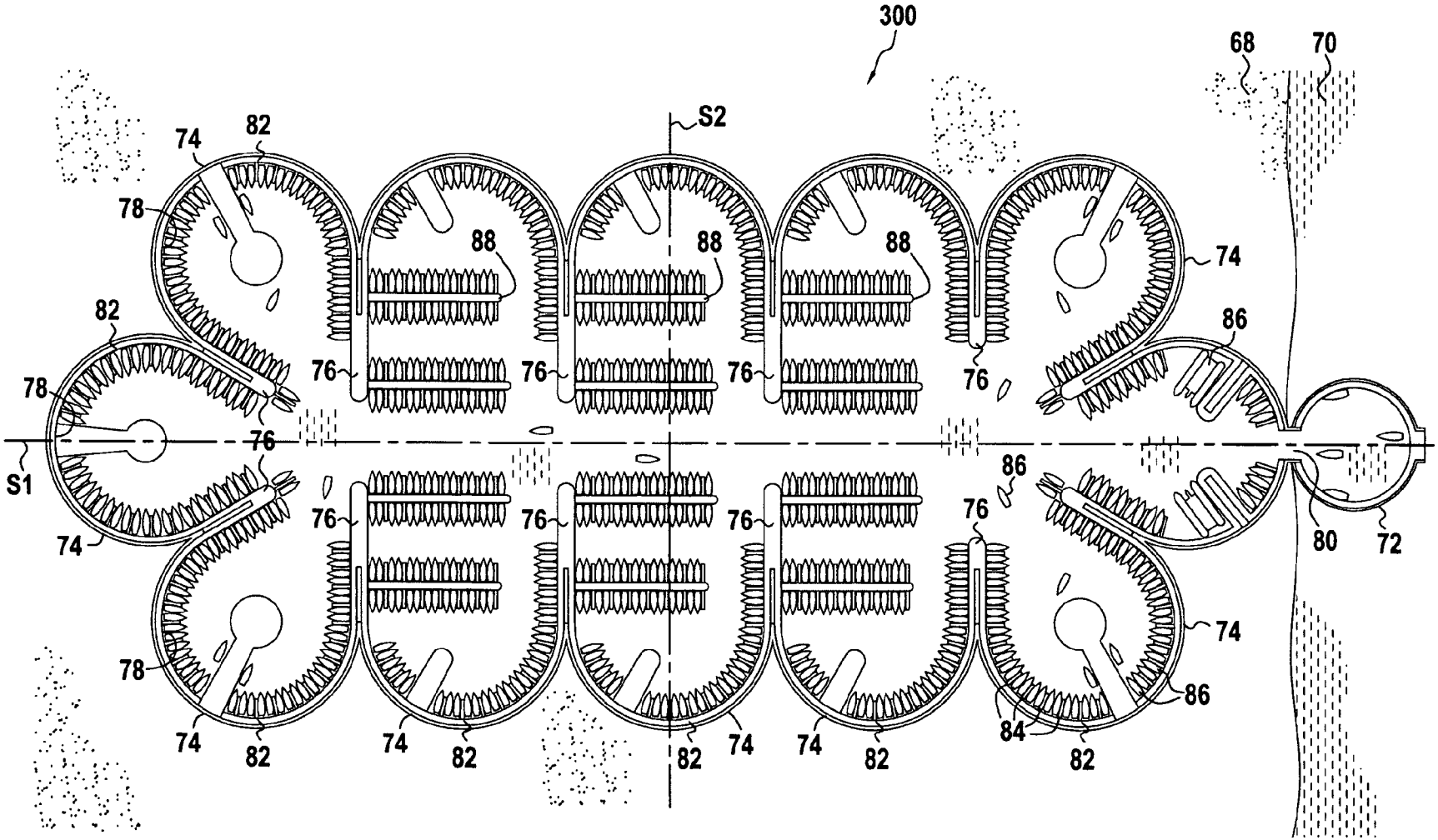
FIG. 11 is a plan view of a third embodiment of the harbor structure of the present invention.

FIG. 11 shows a plan view of a third embodiment of the harbor structure of the present invention.

This harbor structure 300 is a marina built into the coast 68 and suitable for communicating with a stretch of water 70 via a module 72 of the invention that forms an access channel for boats.

The periphery of the harbor structure 300 comprises a continuous wall 73 made up of twelve arcuate wall segments 74 that are set into the ground and that are interconnected via their ends 76.

The access channel 72 and the harbor structure 300 communicate with each other via an opening 80 provided in the continuous wall.

Preferably, said arcuate wall segments are made by diaphragm walls.

Like the other embodiments, the inside volume defined by the arcuate wall segments is dug out to form a dock.

As shown, these arcuate wall segments 74 have their concave sides 78 facing towards the inside of the structure 300 so that each of the arcuate wall segments 74 forms an arch enabling the structure 300 to withstand to the pressure exerted by the ground situated outside the diaphragm wall 73.

In addition, the structure 300 advantageously has two axes of symmetry S1, S2 that are mutually orthogonal.

It can thus be understood that two mutually symmetrical arcuate wall segments are subjected to forces that are opposite and of the same magnitude, so that the forces to which the structure is subjected balance out.

In order to improve take-up of forces between two arcuate segments that are symmetrical about the axis S1, it is possible to make provision for the ends of said two segments to be connected together via reinforcing beams immersed at the bottom of the dock.

As can be seen in FIG. 11, the inside periphery of the continuous wall 73 is provided with floating dock rafts 82 and with mooring and landing piers 84 to which boats 86 can moor.

Preferably, the piers 84 extend orthogonally relative to the rafts 82.

In addition, it is also possible to provide additional floating dock rafts 88 that are disposed orthogonally relative to the ends 76 of the arcuate wall segments 74.

Although a harbor structure made of diaphragm walls is described, it is also possible to make such a harbor structure from cast piles or from reinforced concrete without going beyond the ambit of the present invention. Making a continuous wall out of cast and preferably intersecting piles is technically strictly equivalent to making conventional diaphragm walls.

The method of building of the invention thus makes it possible to imagine building harbor complexes on new sites that are accessible independently of tidal range, that are ecological as regards management of silting up, and that offer good building-cost performance.

Such floating dock rafts adapt to accommodate a large tidal range by means of the self-stability procured by the shape of the harbor structure.

The invention claimed is:

1. A method of building a harbor structure suitable for communicating with a stretch of water, which method comprises:

making, in a piece of ground, at least one curved continuous wall having a closed outline forming a dock for boats and comprising at least two arcuate wall segments connected together via their ends and whose concave sides face each other and open towards the inside of the dock so as to present an arch effect relative to the outside of the structure, putting down fill extending from the coast towards the stretch of water, and making said continuous wall at least in part in the fill, digging out at least a fraction of the ground situated inside a volume defined by the continuous wall, and providing at least one opening in the continuous wall, said opening making it possible to cause said volume to communicate with the stretch of water and enabling a boat to pass through and enter into the dock.

2. The method of building a harbor structure according to claim 1, wherein the ground in which the wall is made is the bottom of a stretch of water.

3. The method of building a harbor structure according to claim 1, wherein the volume defined by the continuous wall is dug out over a fraction of the height of the wall.

4. The method of building a harbor structure according to claim 1, wherein the continuous wall is a diaphragm wall.

5. The method of building a harbor structure according to claim 1, wherein the continuous wall is made up of a plurality of cast piles.

6. The method of building a harbor structure according to claim 1, wherein the continuous wall is made of reinforced concrete.

7. The method of building a harbor structure according to claim 1, wherein the opening is in the shape of a notch formed in an upper portion of the continuous wall.

8. The harbor structure obtained by implementing the method of building according to claim 1.

9. The method of building a harbor structure according to claim 8, wherein the opening is provided in the fraction of continuous wall made in the fill, and wherein the fill is dug out, at least in register with the opening, in a manner such that the volume communicates with the stretch of water.

10. A harbor structure comprising a plurality of curved continuous walls anchored in the ground having a closed outline, said walls being provided with openings and forming docks for boats that communicate with one another via said openings, at least one of the openings communicating with a stretch of water to enable a boat to pass through and enter into the docks, wherein the continuous walls comprises at least two arcuate wall segments connected together via their ends, said arcuate wall segments having their concave sides facing each other and opening towards the inside of the dock so as to present balancing arch effects relative to the outside of the structure, wherein the plurality of continuous walls form an access channel via which a boat can access the stretch of water by going successively through the openings provided in the respective continuous walls.

11. The harbor structure according to claim 10, wherein the continuous wall is a diaphragm wall.

12. The harbor structure according to claim 10 wherein the continuous wall is made up of a plurality of cast piles.

13. The harbor structure according to claim 10, wherein the continuous wall is made of reinforced concrete.

14. The harbor structure according to claim 10, wherein the continuous wall is cylindrical in shape.

15. The harbor structure according to claim 10, wherein the continuous wall is in the shape of a cylinder having a circular base.

16. The harbor structure according to claim 10, wherein the harbor structure is provided with a closure device suitable for closing the wall in watertight manner relative to the stretch of water.

17. The harbor structure according to claim 16, wherein it further comprises a pump device designed to empty the harbor structure of the water it is suitable for containing.

18. The harbor structure according to claim 16, wherein it further comprises a ramp extending along the inside periphery of the harbor structure from an upper portion thereof to a lower portion thereof.

19. The harbor structure according to claim 10, wherein one of the plurality of curved continuous walls has a portion immersed in the stretch of water.

20. A method of building a harbor structure suitable for communicating with a stretch of water, which method comprises: making, in a piece of ground, at least one curved continuous wall having a closed outline and comprising at least one arcuate wall segment whose concave side faces towards the inside of the structure so as to present an arch effect relative to the outside of the structure, putting down fill extending from the coast towards the stretch of water, making said continuous wall at least in part in the fill, digging out at least a fraction of the volume defined by the continuous wall, and providing at least one opening in the continuous wall, said opening making it possible to cause said volume to communicate with the stretch of water.

21. A method of building a harbor structure according to claim 20, wherein the opening is provided in the fraction of continuous wall made in the fill, and wherein the fill is dug out, at least in register with the opening, in a manner such that the volume communicates with the stretch of water.

22. A method of building a harbor structure according to claim 20, wherein the continuous wall comprises a plurality of arcuate wall segments connected together via their ends, said arcuate wall segments having their concave sides facing towards the inside of the structure so as to present arch effects relative to the outside of the structure.

23. A harbor structure obtained by implementing the method of building according to claim 20.

* * * * *

UNITED STATES PATENT AND TRADEMARK OFFICE

CERTIFICATE OF CORRECTION

PATENT NO. : 8,419,315 B2
APPLICATION NO. : 12/084631
DATED : April 16, 2013
INVENTOR(S) : Damien Grimont It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 538 days.

Signed and Sealed this
First Day of September, 2015

Michelle K. Lee

Michelle K. Lee
*Director of the United States Patent and Trademark Office*